US008820255B1

(12) United States Patent
Poppell et al.

(10) Patent No.: US 8,820,255 B1
(45) Date of Patent: Sep. 2, 2014

(54) BOAT EXPANDING AND CONTRACTING APPARATUS

(71) Applicants: Lanny Ralph Poppell, Vero Beach, FL (US); Timothy Ralph Poppell, Vero Beach, FL (US); James Jeffrey Seyler, Palm City, FL (US)

(72) Inventors: Lanny Ralph Poppell, Vero Beach, FL (US); Timothy Ralph Poppell, Vero Beach, FL (US); James Jeffrey Seyler, Palm City, FL (US)

(73) Assignee: Lanny Ralph Poppell, Vero Beach, FL (US)

( * ) Notice: Subject to any disclaimer, the term of this patent is extended or adjusted under 35 U.S.C. 154(b) by 0 days.

(21) Appl. No.: 14/137,740

(22) Filed: Dec. 20, 2013

Related U.S. Application Data

(60) Provisional application No. 61/794,503, filed on Mar. 15, 2013.

(51) Int. Cl.
*B63B 1/00* (2006.01)
*B63B 7/04* (2006.01)

(52) U.S. Cl.
CPC ..... *B63B 7/04* (2013.01)
USPC ..... 114/61.18; 114/354

(58) Field of Classification Search
USPC ..... 114/61.18, 353, 354
See application file for complete search history.

(56) References Cited

U.S. PATENT DOCUMENTS

| | | | | |
|---|---|---|---|---|
| 2,992,444 | A | 7/1961 | Schuler | |
| 3,139,058 | A | 6/1964 | Robinson | |
| 3,925,837 | A | 12/1975 | Miller | |
| 4,909,169 | A * | 3/1990 | Skandaliaris et al. | 114/61.18 |
| 5,265,550 | A | 11/1993 | Harper, Jr. | |
| 5,517,940 | A * | 5/1996 | Beyer | 114/354 |
| 5,829,376 | A | 11/1998 | Kostanski | |
| 5,868,032 | A | 2/1999 | Laskey | |
| 6,003,458 | A * | 12/1999 | Valliere | 114/61.18 |
| 6,067,925 | A | 5/2000 | Little | |
| 6,178,913 | B1 * | 1/2001 | Brignolio | 114/353 |
| 6,298,802 | B1 * | 10/2001 | Brignolio | 114/354 |
| 6,397,769 | B1 | 6/2002 | Bullmer | |
| 6,647,913 | B2 * | 11/2003 | Brignolio | 114/354 |
| 6,725,796 | B2 * | 4/2004 | Mensch | 114/61.18 |
| 6,874,440 | B1 | 4/2005 | Manderfield | |
| 2003/0116072 | A1 | 6/2003 | Brignolio | |
| 2003/0172862 | A1 | 9/2003 | Chacon | |
| 2013/0213288 | A1 | 8/2013 | Hall | |

FOREIGN PATENT DOCUMENTS

| | | |
|---|---|---|
| FR | 2742119 | 6/1997 |
| SU | 524728 | 8/1976 |

OTHER PUBLICATIONS https://www.google.com/patents/US20130213288?dq=velodyne+marine&hl=en&sa-X&ei=aByzUoKnKInskQeLw4DQBQ&sqi=2&pjf=1&ved=0CEAQ6AEwAQ.
http://www.youtube.com/watch?v=Thl3iq1oFXc.
http://www.youtube.com/watch?v=re25D4dfvEA.
International Search Report and Written Opinion issued Jul. 18, 2014 in PCT/US14/23427 filed Mar. 11, 2014.

* cited by examiner

*Primary Examiner* — Lars A Olson
(74) *Attorney, Agent, or Firm* — Oblon, Spivak, McClelland, Maier & Neustadt, L.L.P.

(57) ABSTRACT

A pontoon boat includes two pontoons parallel to the bow to stern axis, and transverse beams which connect the pontoons. The pontoon boat has a width along the transverse beams which can vary from a contracted to an expanded state to allow for storage, and use, respectively.

20 Claims, 25 Drawing Sheets

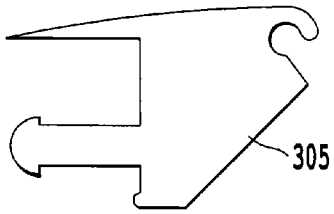
Fig. 8A
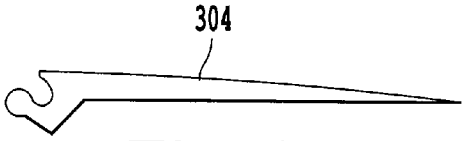
Fig. 8B
Fig. 8C
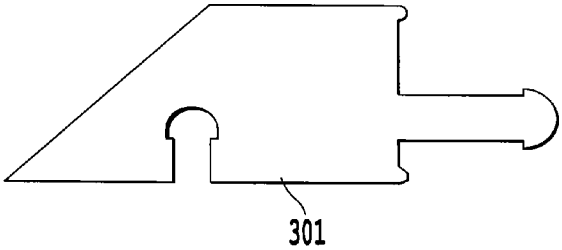
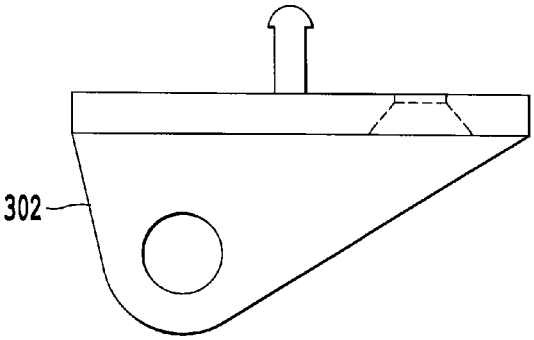
Fig. 8D
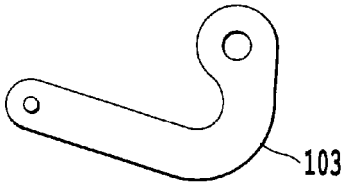
Fig. 8E

BOAT EXPANDING AND CONTRACTING APPARATUS

CROSS-REFERENCE TO RELATED APPLICATIONS

This application claims priority to U.S. Application No. 61/794,503, filed on Mar. 15, 2013, the entire content of which is incorporated in the present document by reference.

SUMMARY

A pontoon boat includes two pontoons parallel to the bow to stern axis, and transverse beams which connect the pontoons. The pontoon boat has a width along the transverse beams which can vary from a contracted to an expanded state to allow for storage, and use, respectively.

BACKGROUND

The present invention relates to a system for boat expansion and contraction.

Getting a boat out of the water can be difficult, even with a suitable boat trailer. The boat must then be carried between the water and a storage location, typically on a trailer. For people who want to protect their boat from the elements and/or who do not have a large amount of storage space, or who want to store their boat at home in the off-season, a boat such as a pontoon boat or party-type boat variant may inconveniently occupy a significant amount of floor space.

Boats such as pontoon boats may have an average length between 16 and 24 feet, with a width between 6 and 10 feet, making them impossible to store in a standard one car garage, or even a two car garage (22×22 feet).

As an alternative to offsite storage, and for users with occasional to sparse use, boats which may be reduced in size and volume may be attractive. To reduce a boat's footprint in storage, other than fully inflatable boats, kit boats currently exist. However, an inconvenience of kit boats is their use of parts and materials which result in a weaker structure, with associated safety concerns and reduced comfort for users.

Due to their nature, kit boats may also inconveniently involve small parts, which are required for assembly but can be lost easily. In addition, poor clearances may lead to an inadequate assembly in a large number of instances.

BRIEF DESCRIPTION OF THE DRAWINGS

The characteristics and advantages of exemplary embodiments are set out in more detail in the following description, made with reference to the accompanying drawings.

FIG. 8A-E depict schematic views of several elements of an exemplary embodiment;

DETAILED DESCRIPTION OF THE PREFERRED EMBODIMENTS

It is an object and feature of an exemplary embodiment described herein to provide a boat expanding and contracting apparatus with a sliding floor. One advantage of an exemplary boat expanding and contracting system described herein is the ability to transport a boat by using narrow trailers which can be pulled on small roads, with the boat at a lower height, hence producing less wind resistance. In other words, an exemplary embodiment has a reduced aerodynamic profile leading to fuel efficiency improvements when transported on a trailer. In an exemplary embodiment, the boat system allows for easy launch and retrieval operations. An exemplary embodiment requires only a small amount of water to launch and retrieve the boat.

In addition, an exemplary embodiment of the boat can be parked inside a typical-size garage, unlike regular pontoon boats, yet provide the full usable surface of a conventional pontoon boat on the water. In exemplary embodiments, the exemplary boat expanding and contracting system described herein can be used on a variety of boat structures, such as a party boat, a Hobie Cat or Power Cat, various catamarans or trimarans, and small to large sailboats with various hull shapes and sizes.

These and other objects, advantages, and features of the exemplary boat expanding and contracting system described herein will be apparent to one skilled in the art from a consideration of this specification, including the attached drawings.

Figure 19:
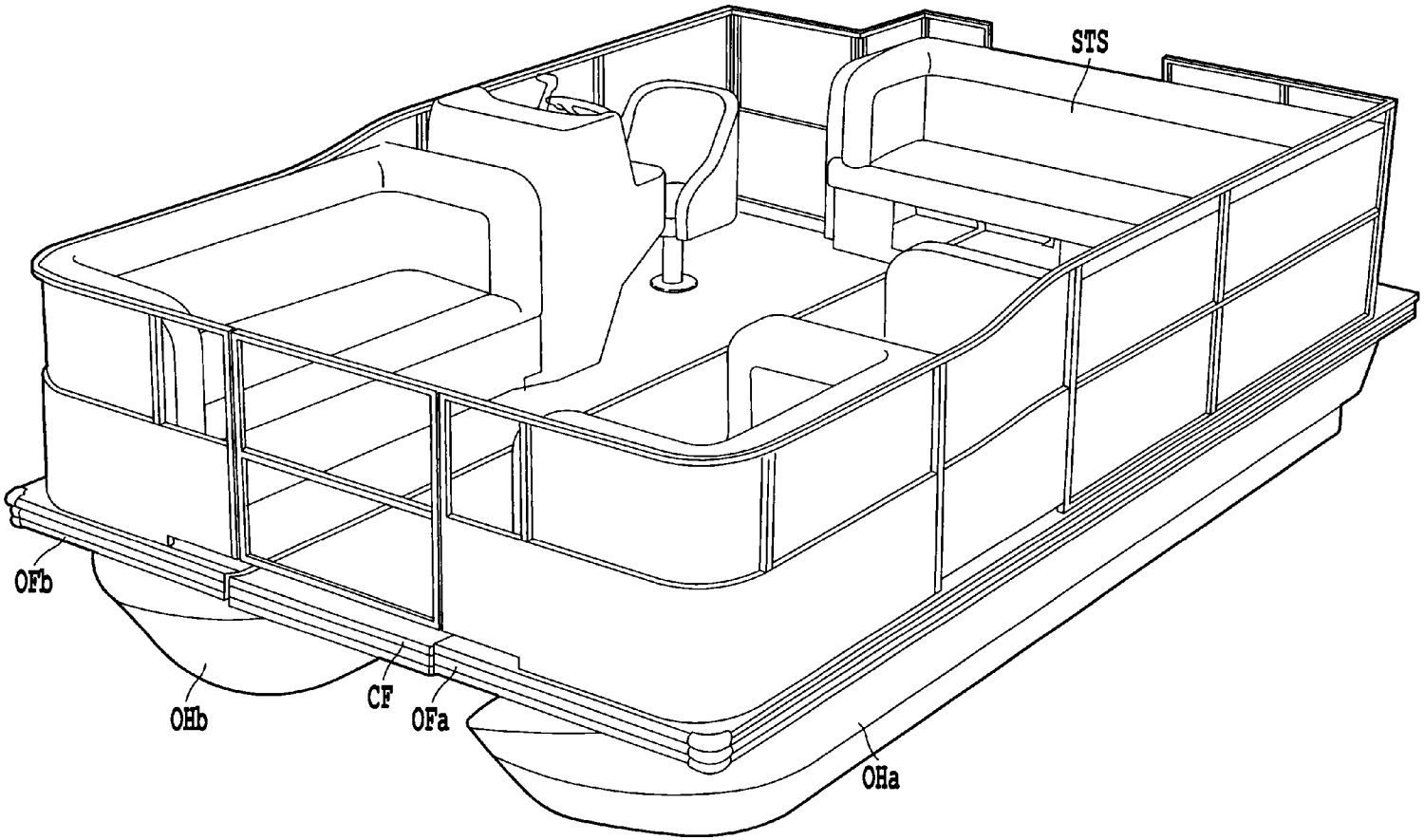
FIG. 19 depicts a three-dimensional representation of a boat using an exemplary embodiment.
Figure 20:
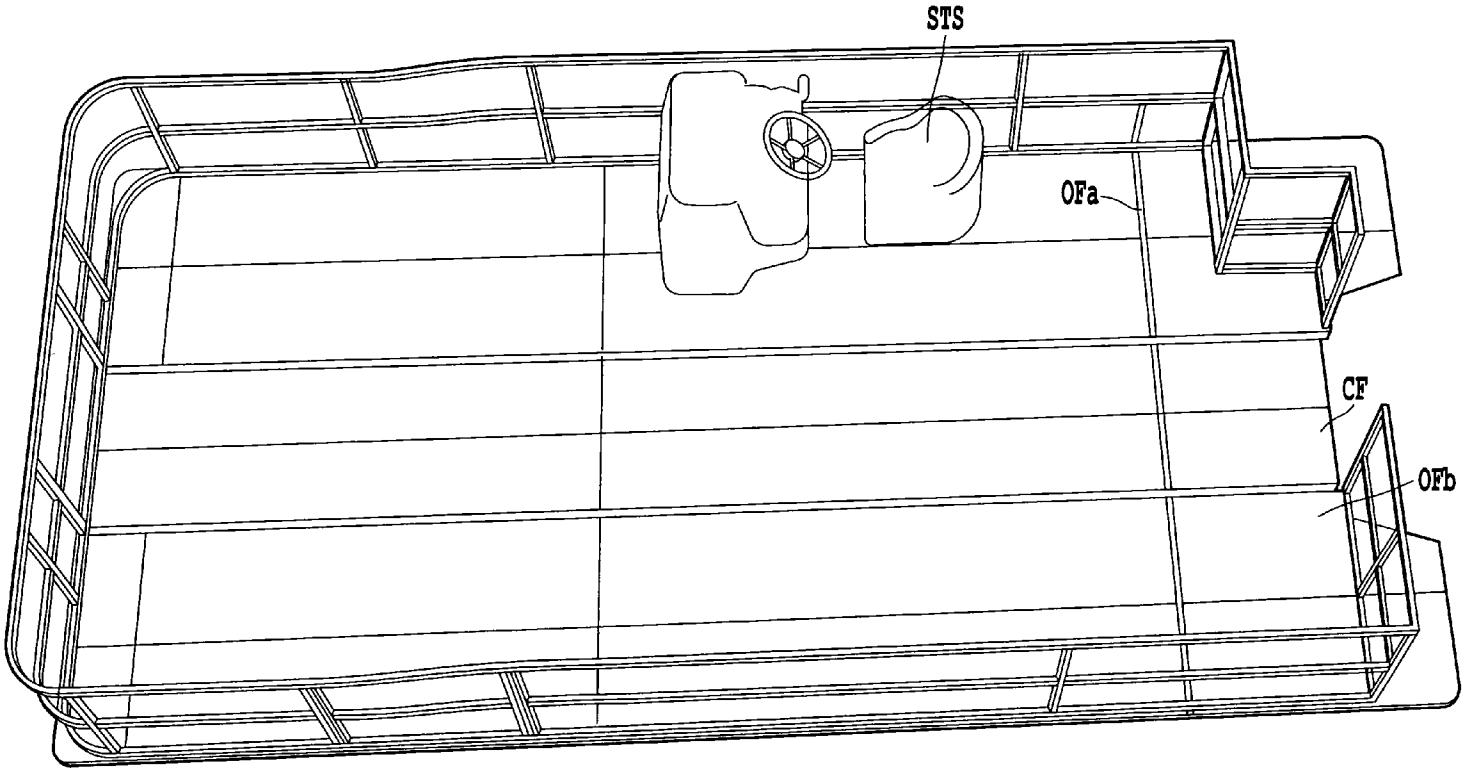
FIG. 20 depicts a schematic upper view of a boat using an exemplary embodiment.

Referring to FIG. 19, an exemplary embodiment of an expanding and contracting system is shown on a pontoon boat with seats (STS), with central panel (CF) and side floor panels (OFa, Ofb). Similarly in FIG. 20, an exemplary embodiment of a boat using the expanding and contracting system is shown. As shown in FIGS. 19 and 20, seats and instrument panels are attached to the side floor panels, while the central floor panel remains free of any attachments. In other exemplary embodiments, the seats can be configured in any number of ways along the sides of the boat, such that the seats can remain in place and allow the expanding and contracting process to take place.

Figure 1:
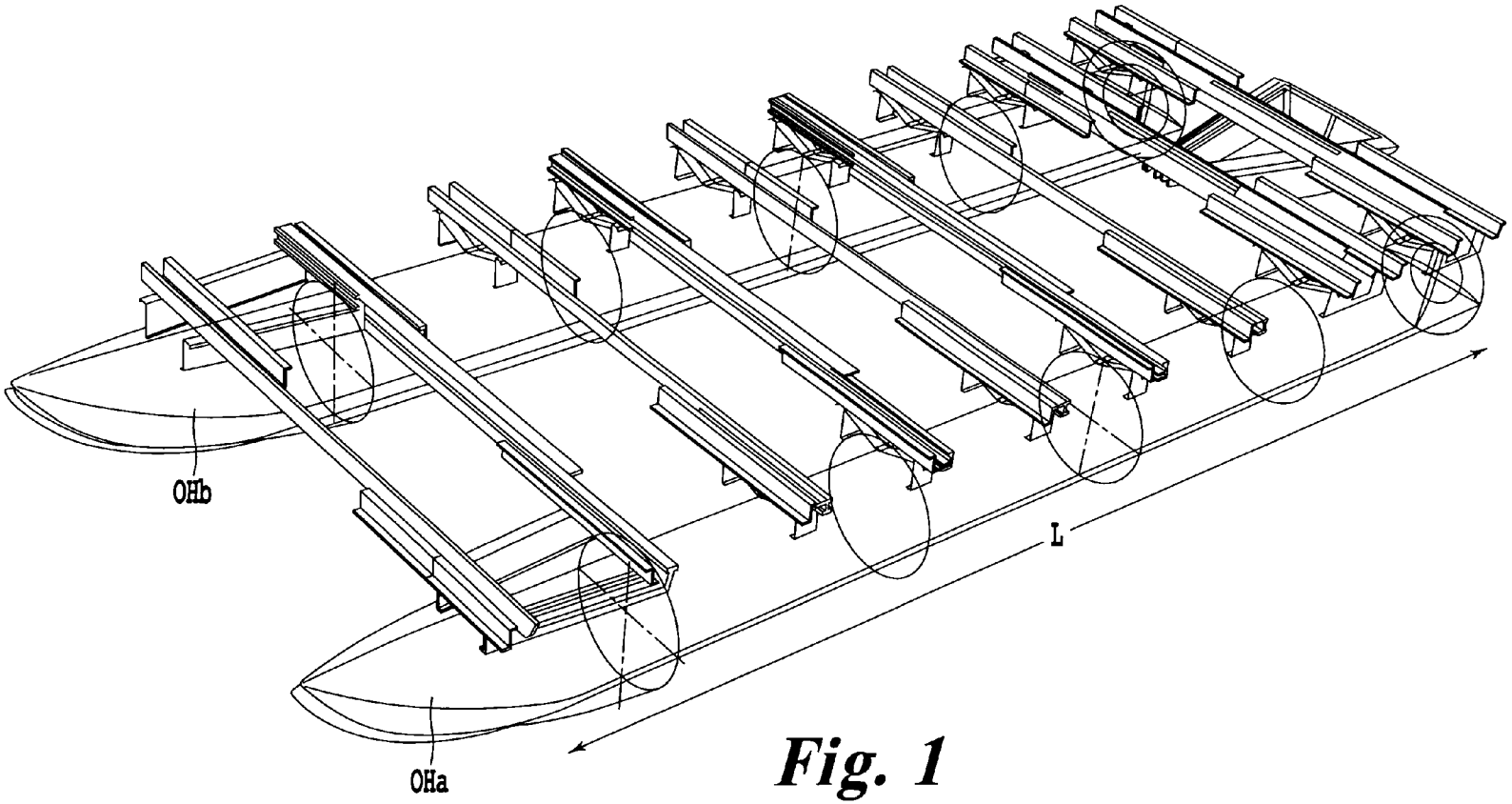
FIG. 1 depicts a schematic isometric view of an exemplary embodiment.

As shown in the exemplary embodiment of FIG. 1, the floor panels of the pontoon boat are located above a structure which includes two pontoons (1) parallel to the bow to stern axis, and transverse beams (2) which connect the pontoons. Floor panels are fixed to the transverse beams (2) which connect the pontoons. In an exemplary embodiment, a railing is present around the boat, and an opening allowing passengers to embark or disembark is aligned with the central panel. In an exemplary embodiment, the engine of the pontoon boat is attached to the boat structural components directly below the central floor panel. Please provide any additional information on the connection between floor panels and the pontoon boat structure.

Figure 2B:
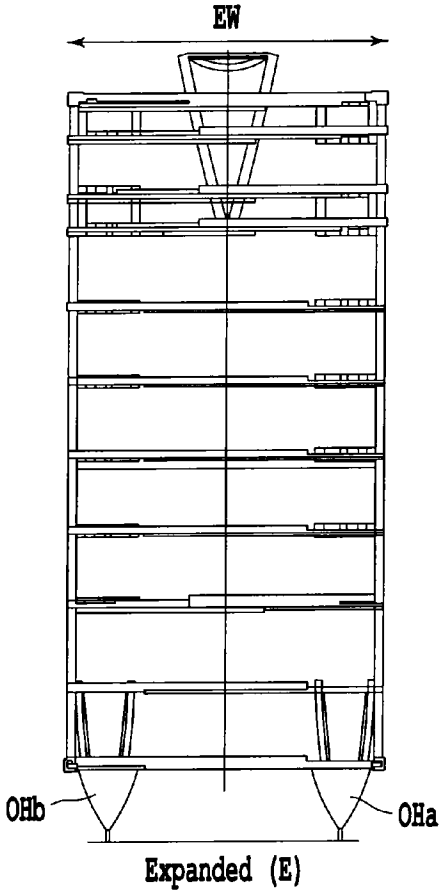
FIGS. 2A-B depict a schematic top view of an exemplary embodiment in contracted and expanded states.
Figure 2A:
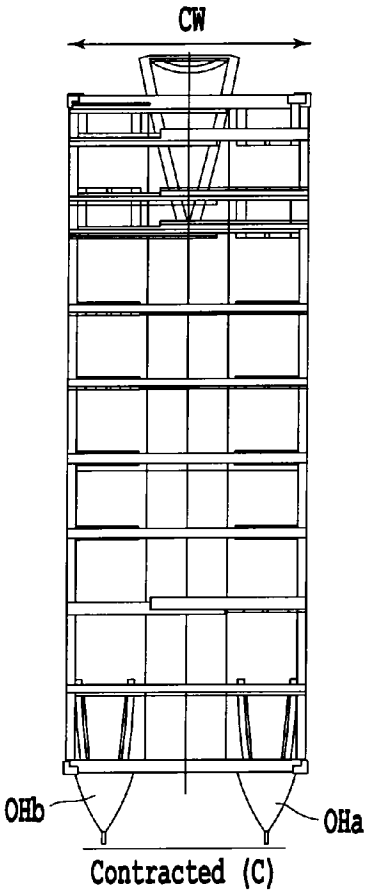

Referring to the exemplary embodiment shown in FIG. 2, the pontoon boat can be in a contracted configuration (C), or in an expanded configuration (E). In the contracted configuration (C), portions of the boat deck or floor, and the associated pontoons are moved inward towards a line along the center of the deck from bow to stern. In this exemplary embodiment, the length (L) of the boat does not vary, but the width of the boat from outer edge to outer edge varies between (CW) in the contracted configuration, and (EW) in the expanded configuration. In an exemplary embodiment, a boat may have an expanded width (EW) of 120", for a contracted width (CW) of 84". In other exemplary embodiments, a boat may have an expanded width between 84" and 120", and a contracted width between 72" and 102".

In an exemplary embodiment, a boat may have an expanded width of 102", for a contracted width of 75". In an exemplary embodiment, a boat may have an expanded width of 104", for a contracted width of 84". In exemplary embodiments, the length (L) of the boat may be between 17'6" to 32', while the increase in width between the contracted and expanded configurations is up to 30".

Figures 3A, 3B:
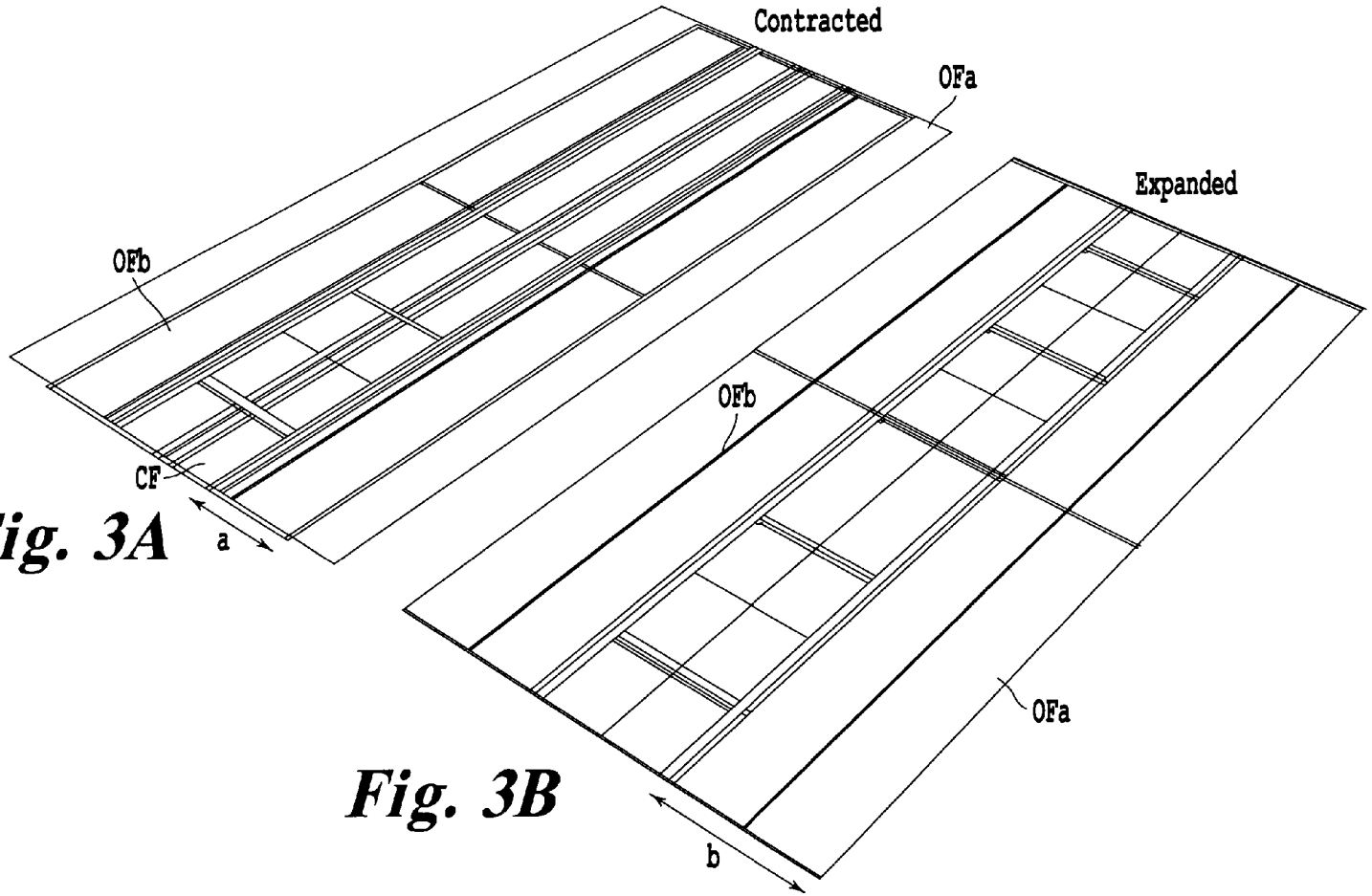
FIGS. 3A-B depict a schematic of the floor of an exemplary embodiment in contracted and expanded states.

As shown in FIG. 3, in an exemplary embodiment, the floor of the boat includes a central floor portion (CF) and two outer floor portions (OFa-b). In the contracted configuration, the outer floors overlap partially with the central floor in the height direction, such that a less-than-full portion of the outer floors, with width (a), protrudes from the central floor in the width direction. In the expanded configuration, the full width (b) of the outer floors protrudes from the central floor portion. Thus, the outer floors do not overlap the central floor portion in the expanded configuration.

Figure 4A:
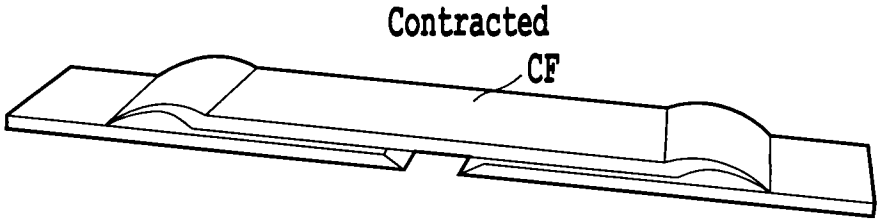
FIGS. 4*a-b* depict isometric views of a portion of the floor of an exemplary embodiment in contracted and expanded states.
Figure 4B:
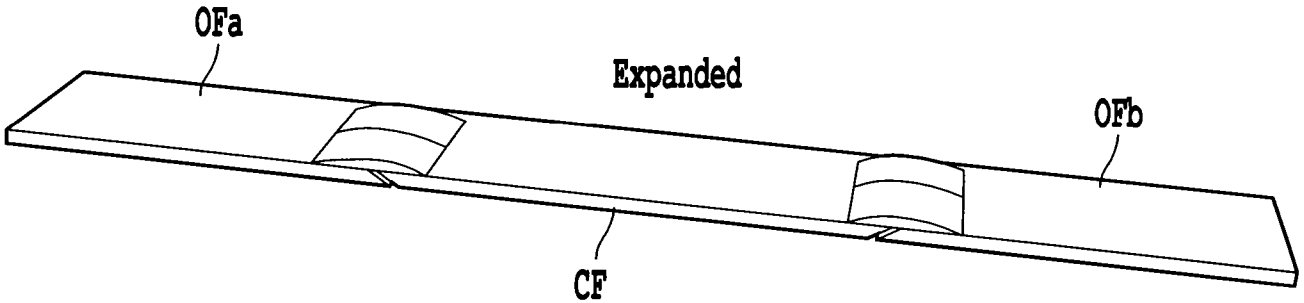

FIGS. 4*a-b* display an exemplary embodiment of a mechanism by which the width of the boat is reduced from the expanded to the contracted configuration. In this exemplary embodiment, the outer floors (OFa-b) slide under the central floor panel (CF). In an alternate embodiment, the outer floors (OFa-b) slide over the central floor panel (CF).

In a first exemplary embodiment, as the central floor panel is raised by two actuating cylinders the outer floor panels move below the raised central floor panel, until they abut each other in the center. The central floor panel, once raised, provides the necessary clearance for the two outer floor panels to come together. In an exemplary embodiment, the transition from contracted to expanded state, and vice versa, can take place while the boat is in use on the water. In an exemplary embodiment an on/off type control such as a lever, switch or button can initiate or end the expansion or contraction of the floor.

In a second exemplary embodiment, the central floor panel is lowered by two actuating cylinders and the outer floor panels move above the lowered central floor panel, until they abut each other in the center. The central floor panel, once lowered, provides the necessary clearance for the two outer floor panels to come together. In an exemplary embodiment, the expansion and/or contraction mechanism carried out by actuator cylinders is powered by DC motors, and/or by manual cranks. The actuators also provide a locking mechanism for both the expanded and contracted states.

Figure 5A:
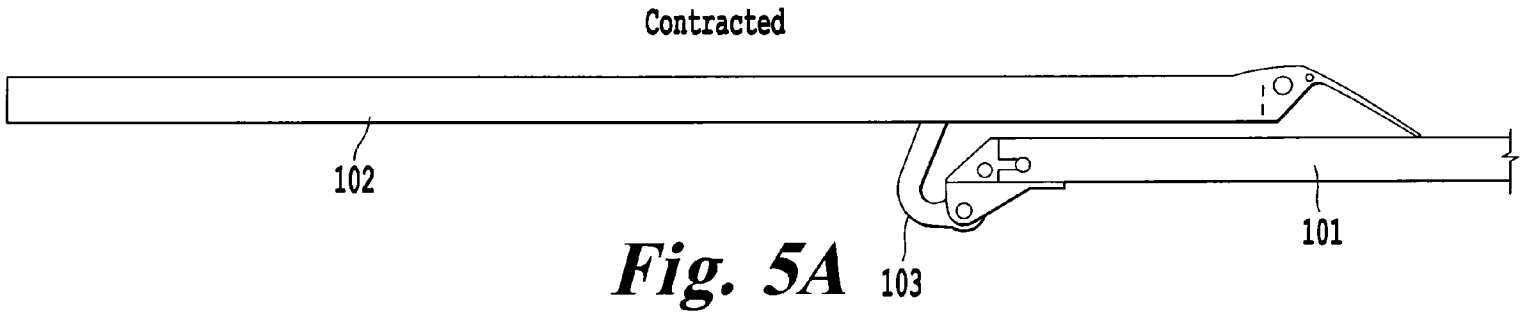
FIGS. 5*a-b* depict cross-sections of a portion of the floor of an exemplary embodiment in contracted and expanded states.
Figure 5B:
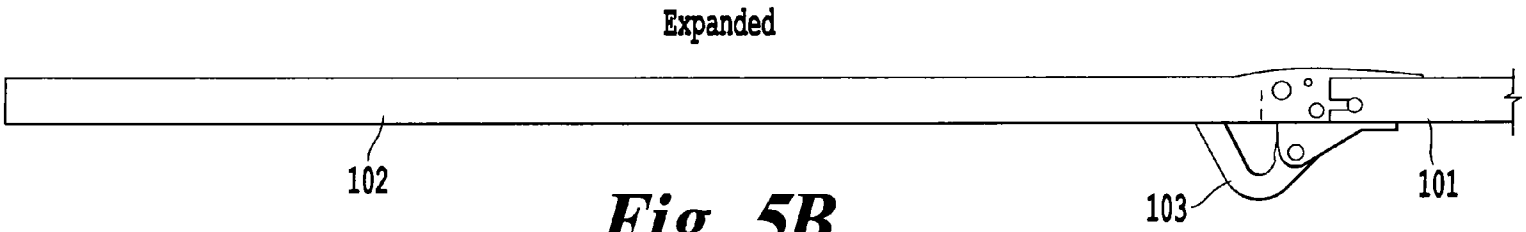

As shown in an exemplary embodiment in FIGS. 5*a* and 5*b*, a pivot and slide mechanism is used to move the outer floor panels from a contracted to an expanded configuration, and vice versa. A beam (101) of an outer floor panel is shown, connected to a J-bracket (103), which moves along the C-track (102) of the central floor panel (CF). In the expanded configuration shown in FIG. 5*b*, the C-track (102) and the beam (101) are level, and the J-bracket (103) is located at an end of the C-track. In the contracted configuration, the C-track (102) partially overlaps the beam (101) which has moved towards the center of the boat, and below the C-track. The floor panels slide below the central panel, and accordingly the central floor board slides over the outer floor panels.

Figure 16B:
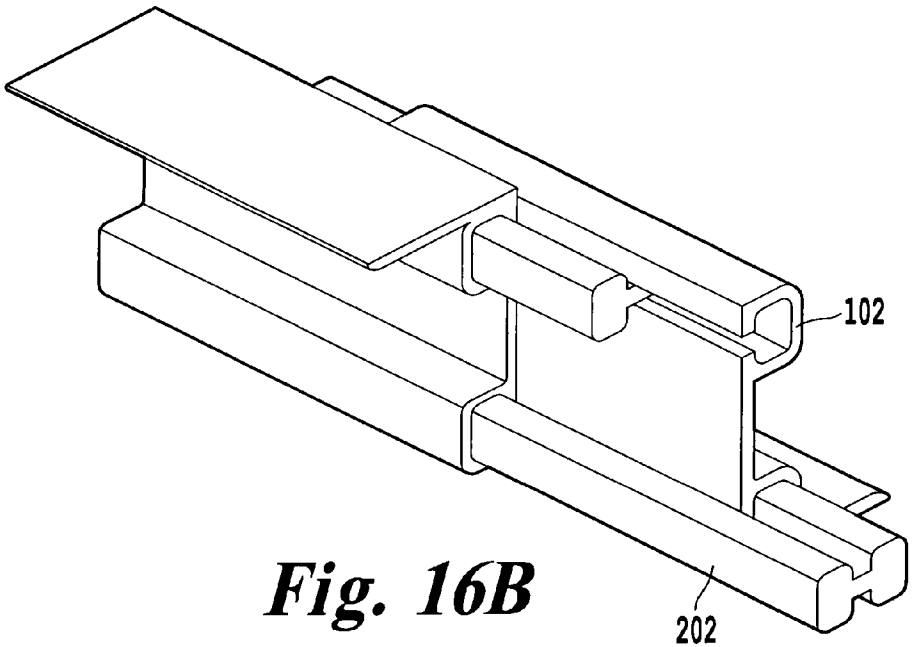
FIGS. 16*a-b* depict the connection between two beams in an exemplary embodiment.
Figure 16A:
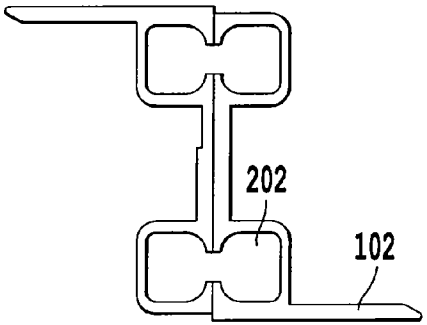

The beams (101) of the outer floor portions can vary in length between the expanded and contracted configurations. As shown in the exemplary embodiment of FIGS. 16*a-b*, a pair of beams (101) can be connected by a dog bone element, such that each beam (101) can slide with respect to the other member of the beam pair.

FIGS. 18*a*-18*d* depict four different beam pairs, with different beam geometries. The exemplary embodiment shown in FIG. 18*a* uses two dog-bone shaped elements, such as element (202*b*) shown in FIG. 18*f*, to connect the beam pair, whereas the exemplary embodiment of FIG. 18*d* uses a single dog-bone shaped element (202*a*) to connect the beam pair. In the exemplary embodiment of FIG. 18*b*, no dog-bone shaped element is required to connect the beam pair of beams (101*a*), as the geometry of each beam allows the interlocking of the beam pair without an additional element. The exemplary embodiment shown in FIG. 18*c* uses a peanut-shaped element, such as the one shown in FIG. 18*e*, to connect the beam pair of beams (101*c*).

Figure 17:
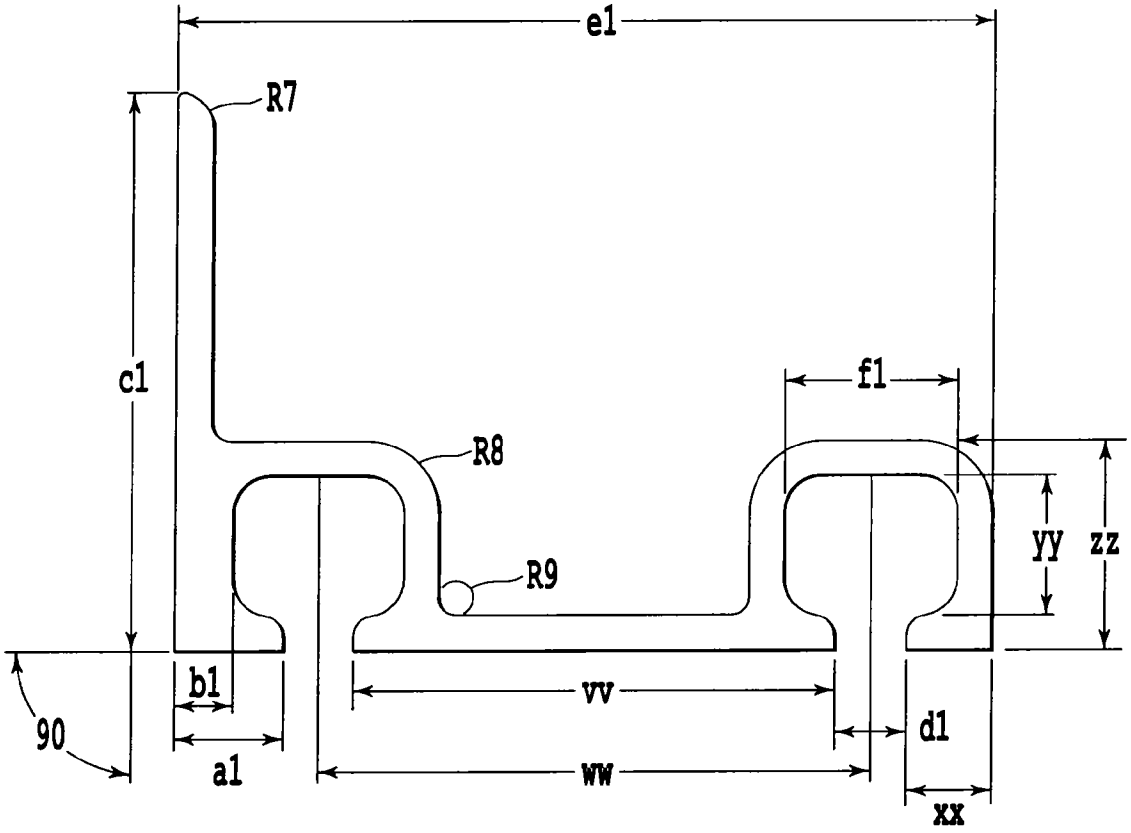
FIG. 17 depicts a schematic view of a beam cross-section in an exemplary embodiment.
Figure 18A:
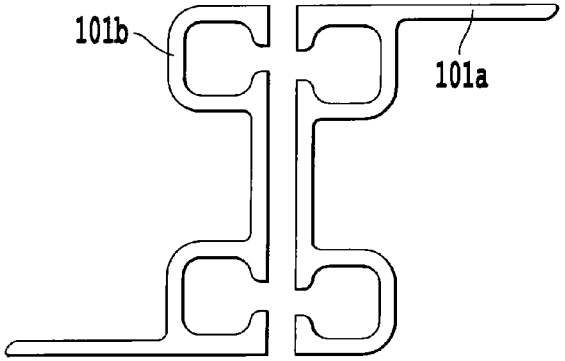
FIGS. 18*a-f* depict beam configurations and assemblies in exemplary embodiments.
Figure 18B:
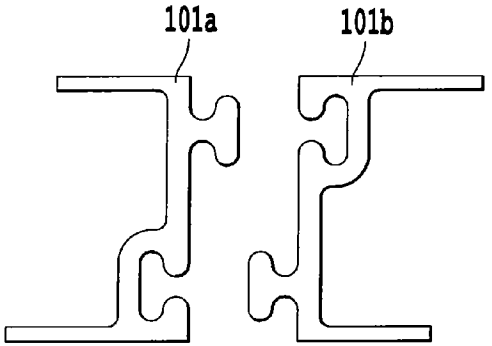
Figure 18C:
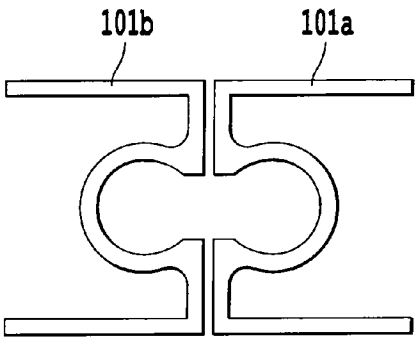
Figure 18F:
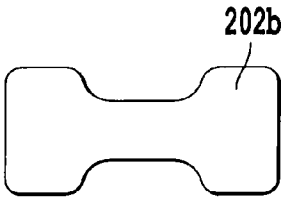
Figure 18E:
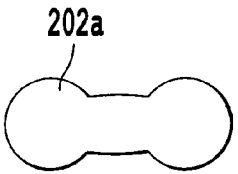

Referring to the exemplary embodiment shown in FIG. 17, and FIG. 18*a*, a beam (101*a*), such as that shown in FIG. 18*a* has overall dimensions e1 and c1, with widths a1, b1, vv, ww, d1, xx and f1, heights yy, and zz, and radii R7, R8, and R9. In a preferred embodiment, e1 is 2.938", c1 is 2.000", a1 is 0.376", b1 is 0.188", vv is 1.750", ww is 2.000", d1 is 0.250", xx is 0.313", f1 is 0.625", yy is 0.500", zz is 0.750", R7 is 0.125", R8 is 0.280" and R9 is 0.062". In alternative embodiments, e1 is between 2.9 and 3.0", c1 is between 1.9 and 2.1", a1 is between 0.3 and 0.4", b1 is between 0.18 and 0.2", vv is between 1.7 and 1.8", ww is between 1.9 and 2.1", d1 is between 0.23 and 0.27", xx is between 0.3 and 0.4", f1 is between 0.6 and 0.65", yy is between 0.45 and 0.55", zz is between 0.7 and 0.8", R7 is between 0.12 and 0.13", R8 is between 0.25" and 0.3" and R9 is between 0.06" and 0.08".

Figure 18D:
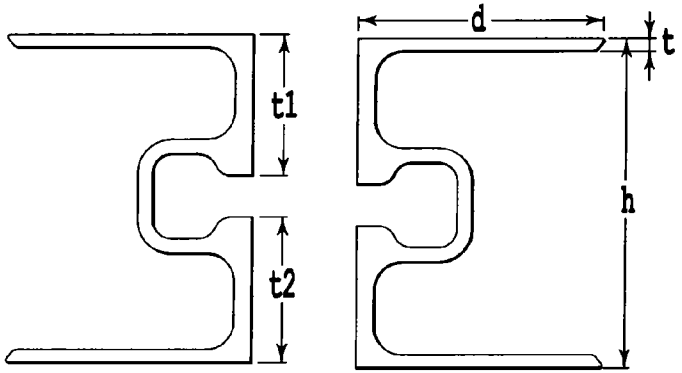

Referring to the exemplary embodiment of FIG. 18*d*, a beam (101*d*) has a cross-section with overall dimensions d, t and h, and with widths t1 and t2. In an exemplary embodiment, d is 2", t is ⅛", h is 2 15/16", t1 is 1¼" and t2 is 1 5/16". In alternative embodiments, d is between 1.8" and 2.1", t is between 0.1" and 0.15", h" is between 2.9" and 3.1", t1 is between 1.2" and 1.3", and t2 is between 1.3" and 1.4".

Figure 6:
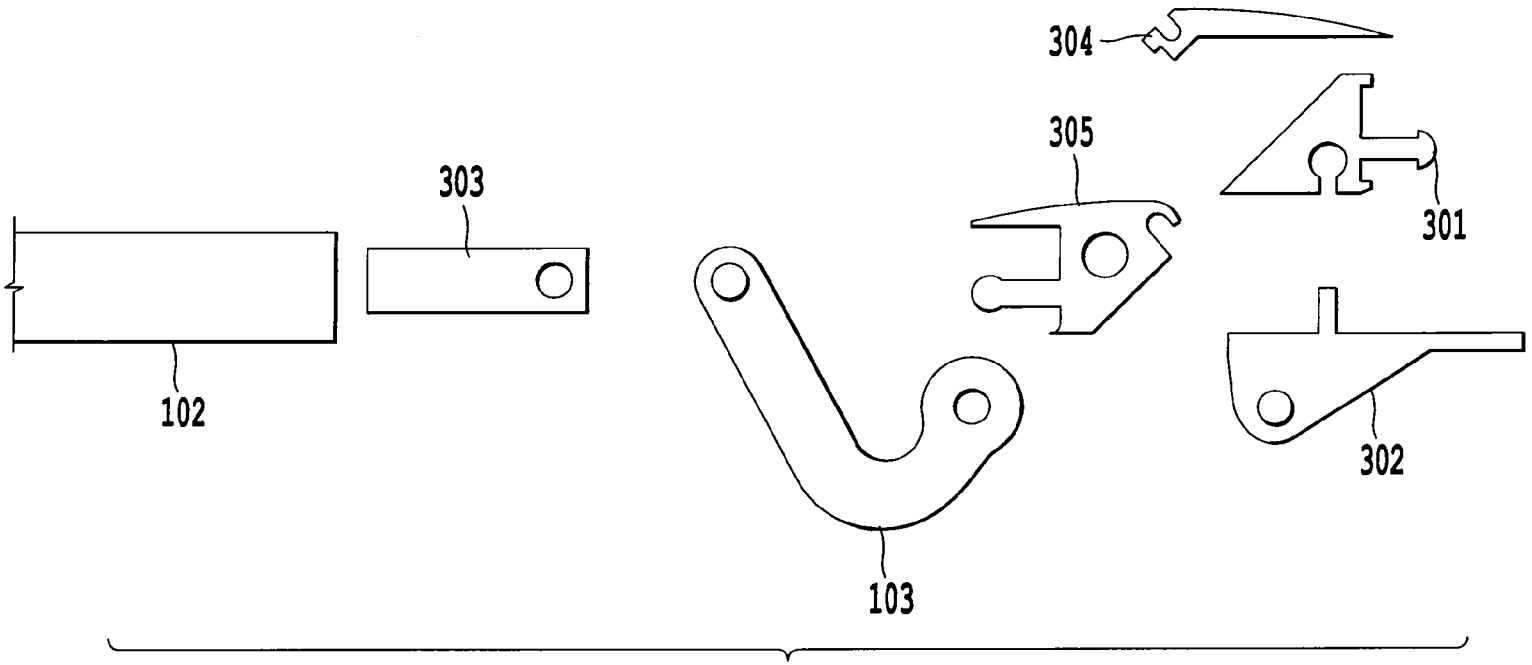
FIG. 6 depicts a portion of the assembly of an exemplary embodiment.
Figure 7A:
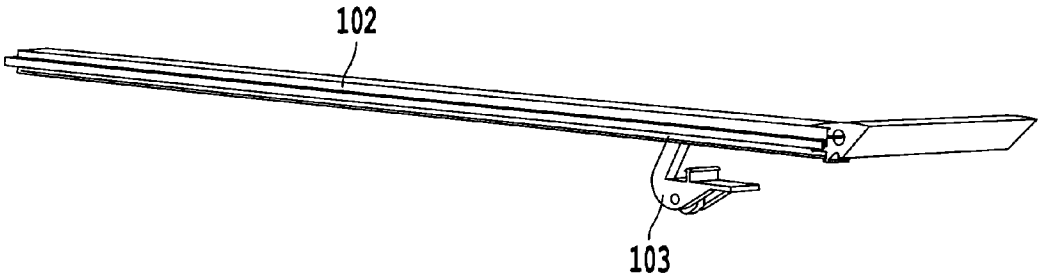
FIGS. 7*a-c* depict isometric views of a portion of the assembly of an exemplary embodiment.
Figure 7B:
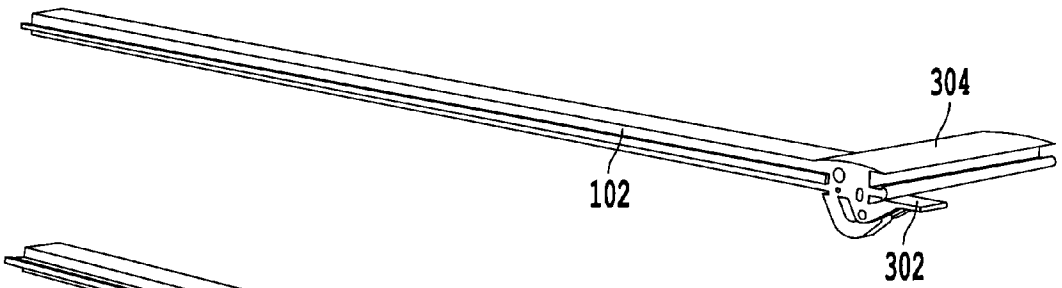
Figure 7C:
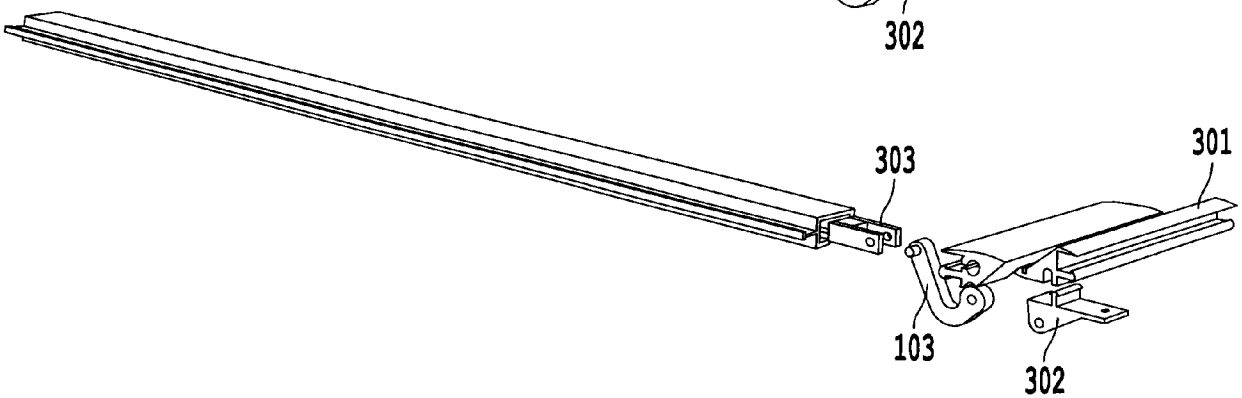
Figure 12:
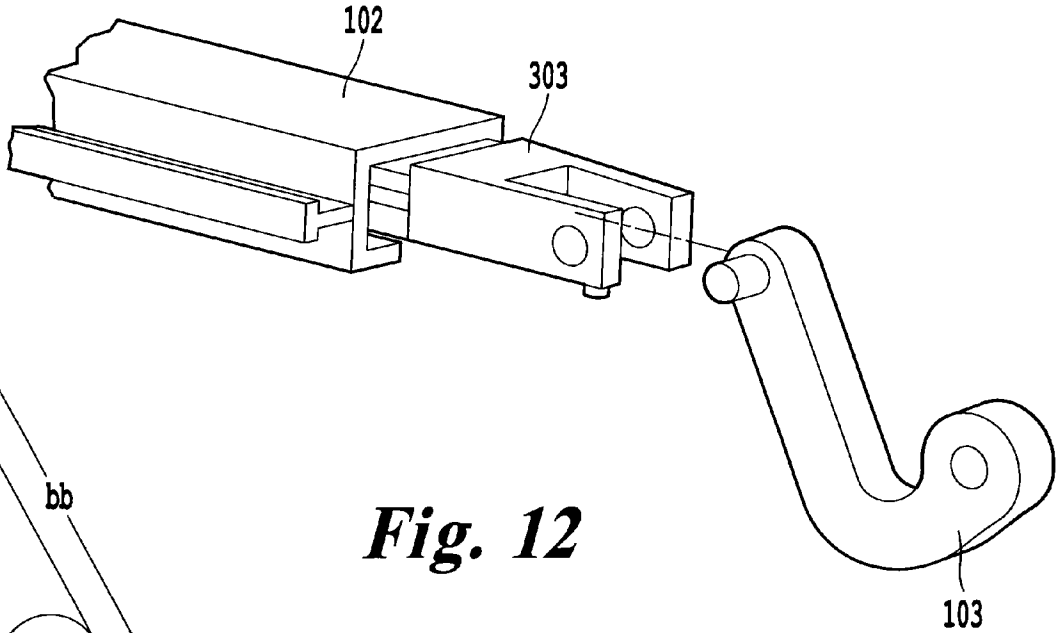
FIG. 12 depicts an isometric view of an assembly of an exemplary embodiment.
Figure 14A:
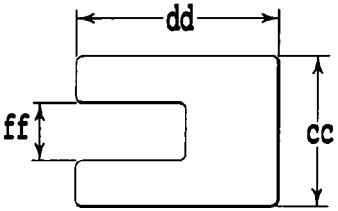
FIGS. 14*a-b* depict schematic views of a slide of an exemplary embodiment.
Figure 14B:
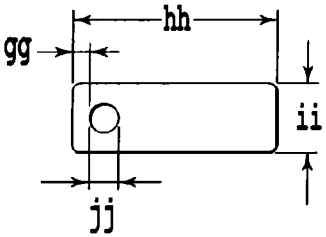

FIG. 6 displays some of the elements used to connect a C-track to a beam. Referring to the exemplary embodiment shown in FIG. 12, the slide fits within the C-bracket beam, and a pin of the J-bracket connects the J-bracket and the slide. The J-bracket (103) is attached to a slide (303) on one end, and to an inner end cap (305) at the other end, such that the J-bracket can pivot about the slide (303) as the slide moves along the C-track (102). Referring to the exemplary embodiment in FIGS. 14*a-b*, the slide element (303) has overall dimensions dd, ee and ii, with a slot width ff, and through holes with a diameter jj, at a distance gg from the edge of the slide. In a preferred embodiment, dd is 1.5", ee is 1.13", ii is 0.48", ff is 0.44", jj is 0.22" and gg is 0.13". In alternative embodiments, dd is between 1.25" and 1.75", ee is between 1.1" and 1.5", ii is between 0.45" and 0.52", ff is between 0.4" and 0.5", jj is between 0.2" and 0.25" and gg is between 0.1" and 0.2".

Figure 15:
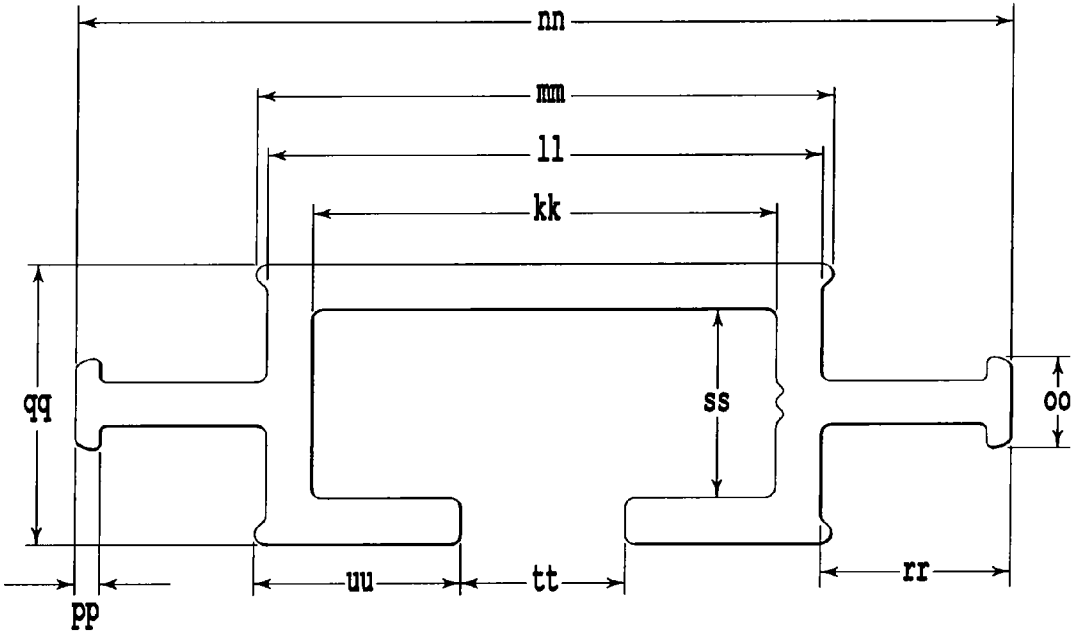
FIG. 15 depicts a schematic view of a C-track of an exemplary embodiment.

Referring to the exemplary embodiment shown in FIG. 15, the C-track beam (102) has overall dimensions qq and nn, with widths pp, uu, tt, ss, rr, kk, ll, mm, and nn, with a height oo. The C-track has inside radii R6, and outside radii R4 and R5. In a preferred embodiment, qq is 0.750", nn is 2.480", pp is 0.060", uu is 0.561", tt is 0.438", ss is 0.500", rr is 0.490", kk is 1.250", ll is 1.500", mm is 1.560" and nn is 2.480", with a height oo of 0.250". In this embodiment R6 is 0.031", R4 is 0.030" and R5 is 0.030". In alternative embodiments, qq is between 0.7" and 0.8", nn is between 2.4" and 2.51", pp is between 0.050" and 0.070", uu is between 0.55" and 0.57", tt is between 0.4" and 0.5", ss is between 0.45" and 0.55", rr is between 0.450" and 0.520", kk is between 1.2" and 1.3", 11 is between 1.4" and 1.600", mm is between 1.5" and 1.6", and nn is between 2.4" and 2.5", with a height oo between 0.24" and 0.26". In these embodiments R6 is between 0.03" and 0.04", R4 is between 0.028" and 0.032" and R5 is between 0.028" and 0.032".

Figure 13:
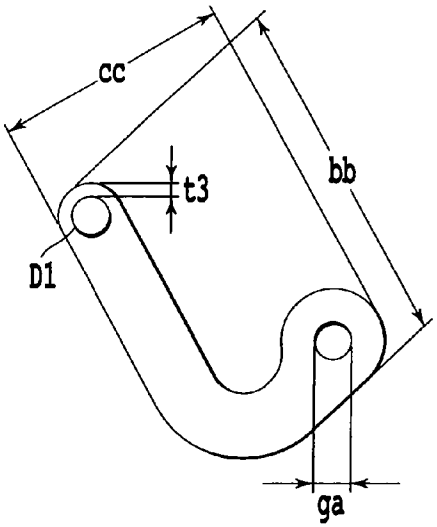
FIG. 13 depicts a schematic view of a J-bracket of an exemplary embodiment.

Referring to the exemplary embodiment of a J-bracket (103) shown in FIG. 13, the J-bracket has overall dimensions cc and bb, with a hole at one end with diameter aa, and a pin on its other end, with diameter D1, at a distance t3 from the edge of the J-bracket. In a preferred embodiment, cc is 1.50", bb is 2.27", aa is 0.25°, D1 is 0.23" and t3 is 0.10". In alternative embodiments, cc is between 1.25" and 1.75", bb is between 2.2" and 2.3", aa is between 0.2" and 0.3", D1 is between 0.2" and 0.25", and t3 is between 0.05" and 0.15".

When transitioning between contracted and expanded configurations, the slide moves along the C-track, while the J-bracket can pivot about the slide, to lower or raise the outer floor portions.

As shown in FIG. 6, the inner end cap (305) is connected to the J-bracket (103), to the outer end cap (301), to the guide pad eye (302), and to an end cap toe guard (304). In an exemplary embodiment, the end cap toe guard provides a smooth transition between the raised central panel and the side panels when the boat is in a contracted configuration.

Figure 10:
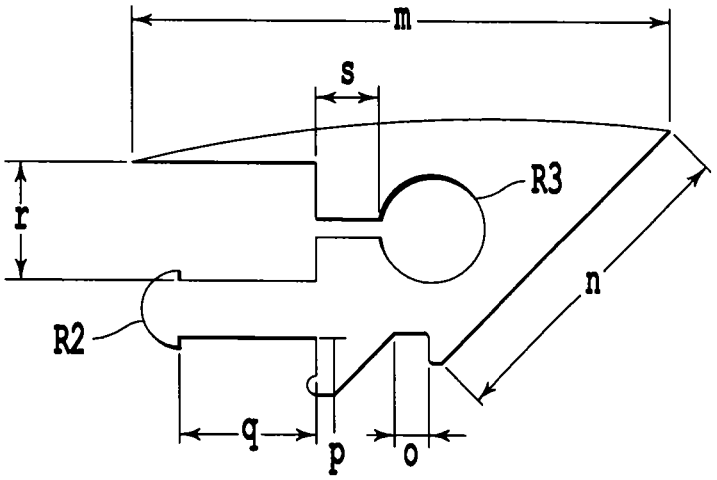
FIG. 10 depicts a schematic view of an inner end cap of an exemplary embodiment.

Referring to the exemplary embodiment shown in FIG. 10, an inner end cap (305) has width dimensions m, q, s and o, with height dimensions r and p. A central tab has a radius R2, and a central hole has a radius R3. In an exemplary embodiment the central hole is a cut-out of any shape, intended to reduce the amount of material and the associated weight of the part. The portion of the inner end cap which interfaces with the outer end cap has a length n. In a preferred embodiment, m is 1.743", q is 0.447", s is 0.205", and o is 0.102". Similarly, in a preferred embodiment, r is 0.381", p is 0.177", R2 is 0.125", and R3 is 0.170". In alternative embodiments, m is between 1.7" and 1.8", q is between 0.4" and 0.5", s is between 0.2" and 0.21", and o is between 0.1" and 0.11". Similarly, in alternative embodiments, r is between 0.3" and 0.4", p is between 0.15" and 0.2", R2 is between 0.12" and 0.13", and R3 is between 0.16" and 0.18".

Figure 9:
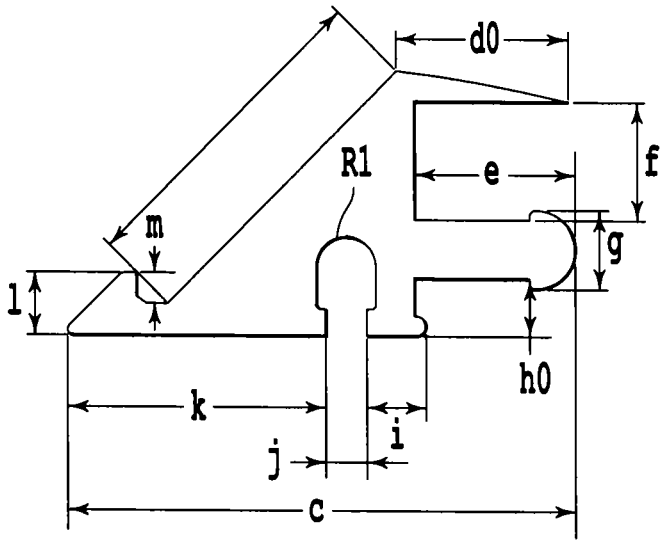
FIG. 9 depicts a schematic view of an outer end cap of an exemplary embodiment.

Referring to the exemplary embodiment shown in FIG. 9, an outer end cap (301) has width dimensions e, i, j, k, and d0, with an overall width c; and height dimensions g, f, h0, l and m. The portion of the outer end cap which interfaces with the inner end cap has a length n. The slot which interfaces with the guide pad eye has a radius R1. In a preferred embodiment, e is 0.50", i is 0.186", j is 0.135", k is 0.844", and d0 is 0.551", while c is 1.627". Similarly, in a preferred embodiment, g is 0.252", f is 0.384", h0 is 0.181", l is 0.200" and m is 0.100", with R1 0.097". In alternative embodiments, e is between 0.4" and 0.55", i is between 0.1" and 0.2", j is between 0.13" and 0.14", k is between 0.8" and 0.9", d0 is between 0.5" and 0.6", while c is between 1.5" and 1.7". Similarly, in alternative embodiments, g is between 0.2" and 0.3", f is between 0.3" and 0.4", h0 is between 0.1" and 0.2", l is between 0.15" and 0.25" and m is between 0.09" and 0.11", with R1 between 0.095" and 0.099".

Figure 11A:
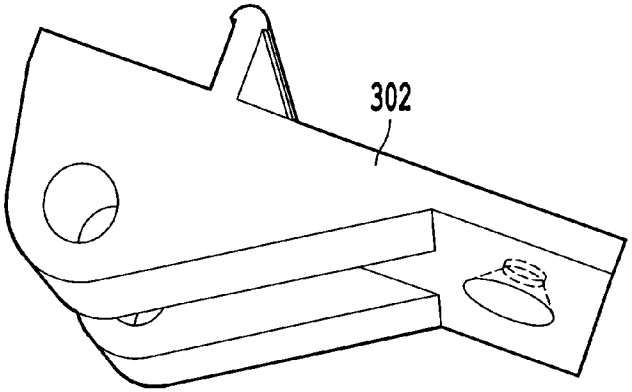
FIGS. 11*a-c* depict schematic views of a guide pad eye of an exemplary embodiment.
Figure 11B:
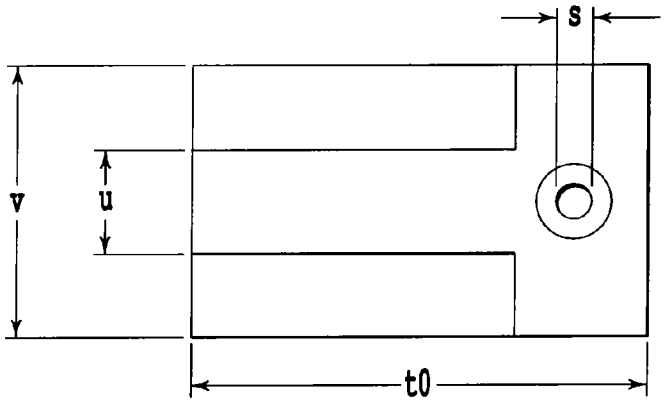
Figure 11C:
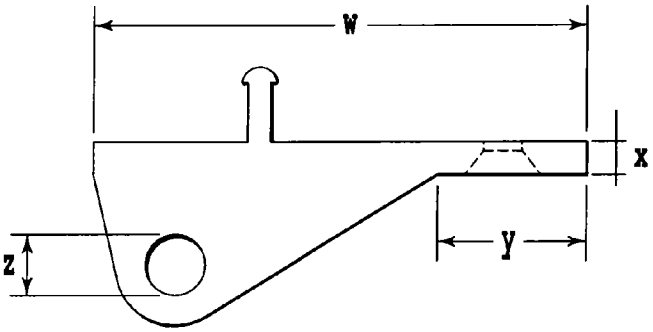

Referring to the exemplary embodiment shown in FIGS. 11*a-c*, the guide pad eye (302) has overall dimensions v and w, with a slot width u, pin diameter s, plate thickness x, hole diameter z, and overhang length y. In a preferred embodiment, v is 1.13", w is 2.04", u is 0.44", s is 0.16", z is 0.25", x is 0.13" and y is 0.61". In alternative embodiments, v is between 1.1" and 1.15", w is between 2" and 2.1", u is between 0.4" and 0.5", s is between 0.14" and 0.18", z is between 0.23" and 0.27", x is between 0.11" and 0.15", and y is between 0.59" and 0.63".

Figure 21A:
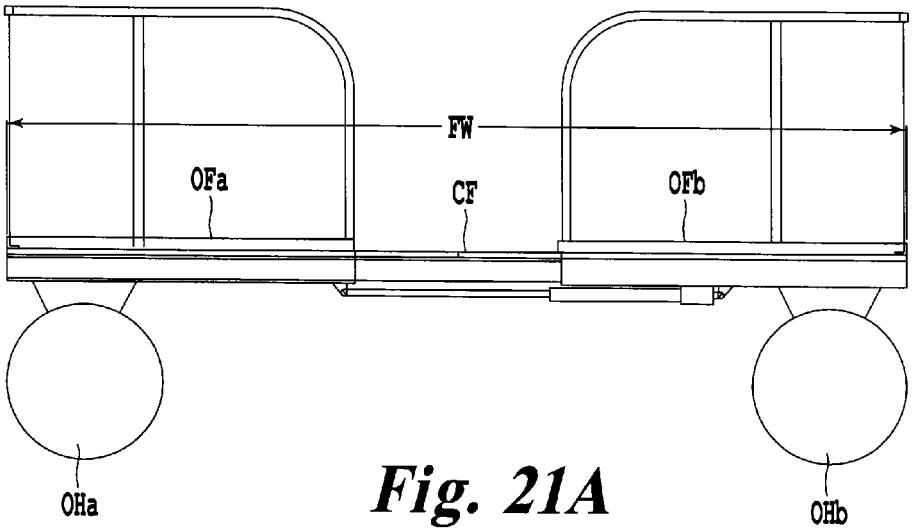
FIGS. 21A-B depict expanded and contracted views of an exemplary embodiment.
Figure 21B:
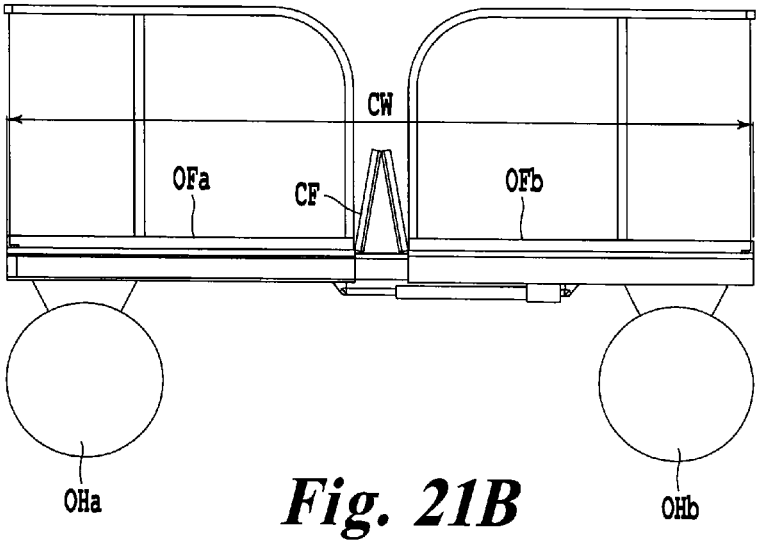

In an alternate embodiment, as shown in FIGS. 21A-B, the central panel (CF) includes a central hinge. Accordingly, in the contracted configuration, as shown in FIG. 21B, the central panel folds up. In exemplary embodiments, in the contracted configuration, the folded central panel is 15" in height, and between 2 and 2.5" wide. In alternative embodiments, the central panel includes two hinges, and folds up as a tripartite panel. In alternative embodiments, the central panel folds down below the main deck surface.

Figure 22A:
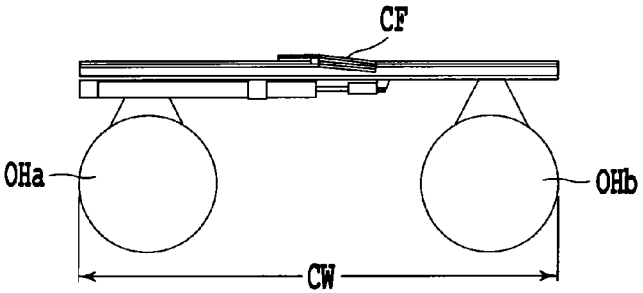
FIGS. 22A-B depict expanded and contracted views of an exemplary embodiment.
Figure 22B:
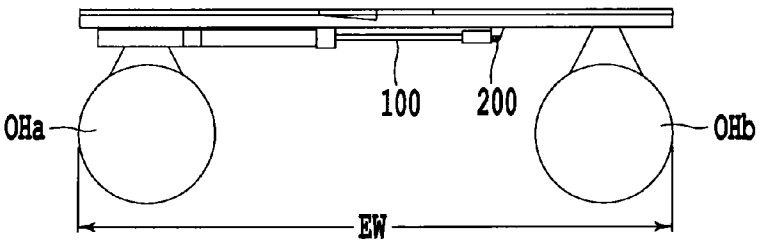

In an alternate embodiment, as shown in FIGS. 22A-B, an expanding and contracting mechanism includes a rod (100) and a sprocket or gear (200), with the central panel which in the contracted position overlaps at least one side panel. In another embodiment, the central panel may also include hinges.

Figure 23A:
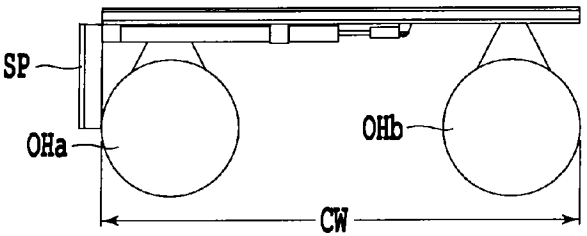
FIGS. 23A-B depict expanded and contracted views of an exemplary embodiment.
Figure 23B:
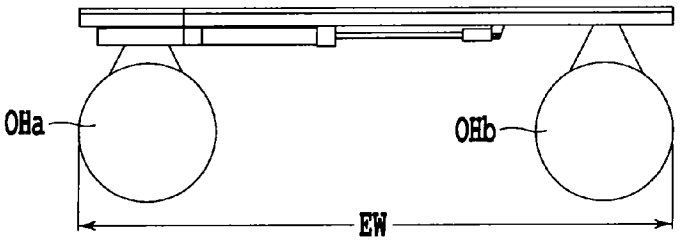

In an alternate embodiment, as shown in FIGS. 23A-B, a rod (100) and a sprocket or gear (200) drive the expansion and contraction, with a side panel (SP) which is located at an edge of the boat deck. In an exemplary embodiment, the side panel (SP) is hinged, and in the contracted position, as shown in FIG. 23A, rests vertically at an edge of the boat deck. In an exemplary embodiment, as shown in FIG. 23B, under the action of the rod and sprocket mechanism, the side panel is moved from a vertical to a horizontal position.

Figure 24A:
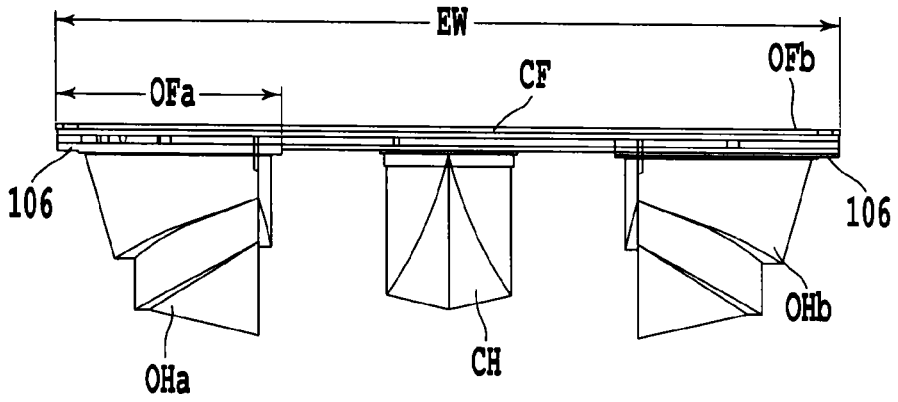
FIGS. 24A-E depict an expanded cross-sectional view, a contracted cross-sectional view, and a side view of an exemplary embodiment.
Figure 24B:
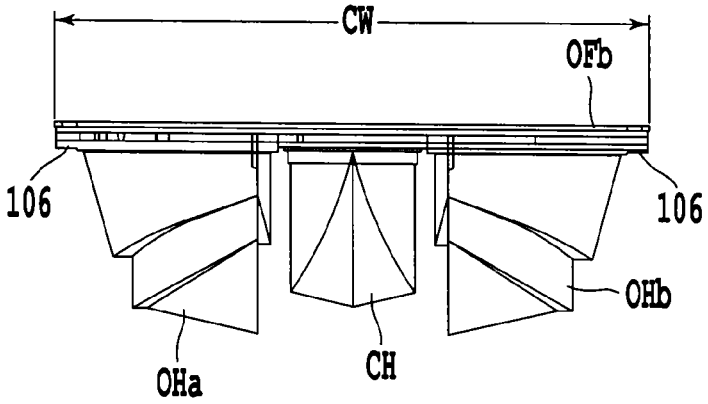
Figure 24C:
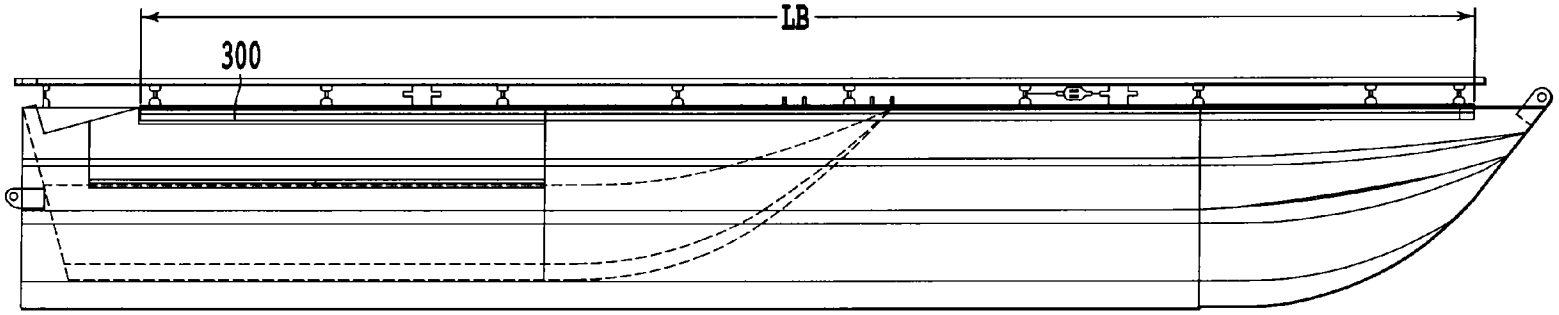
Figure 24D:
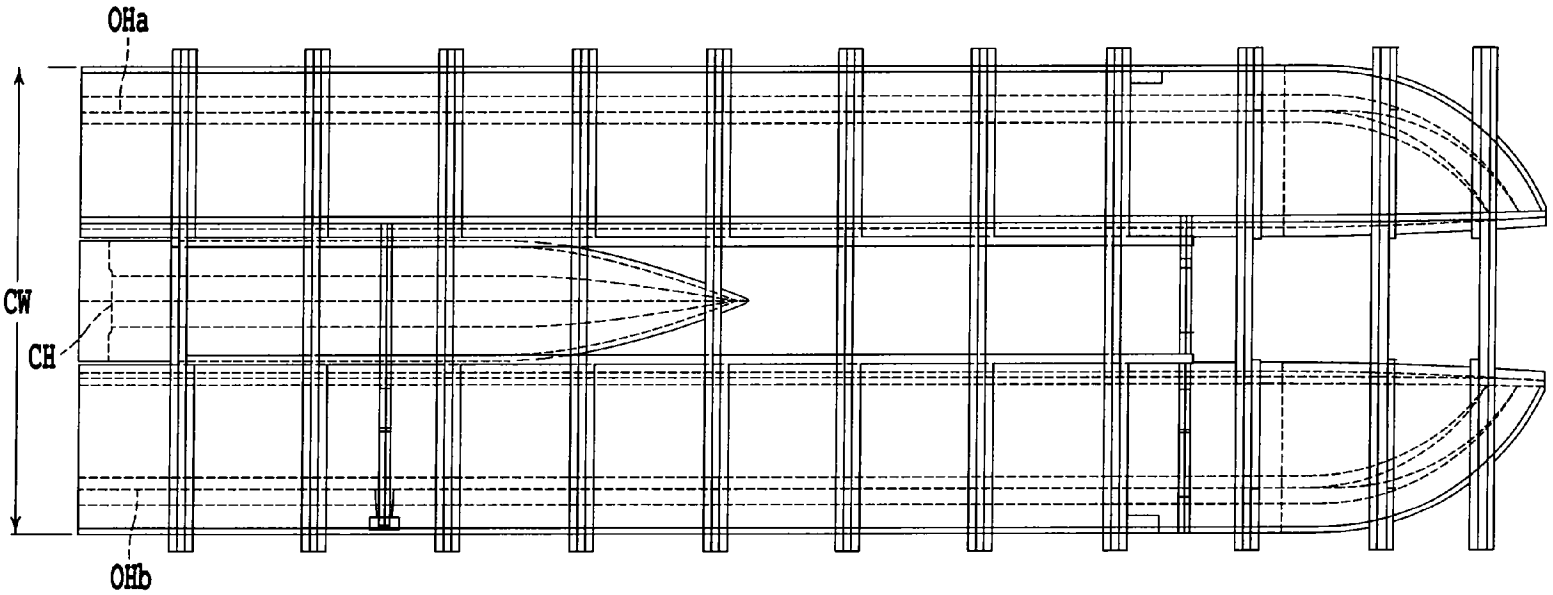
Figure 24E:
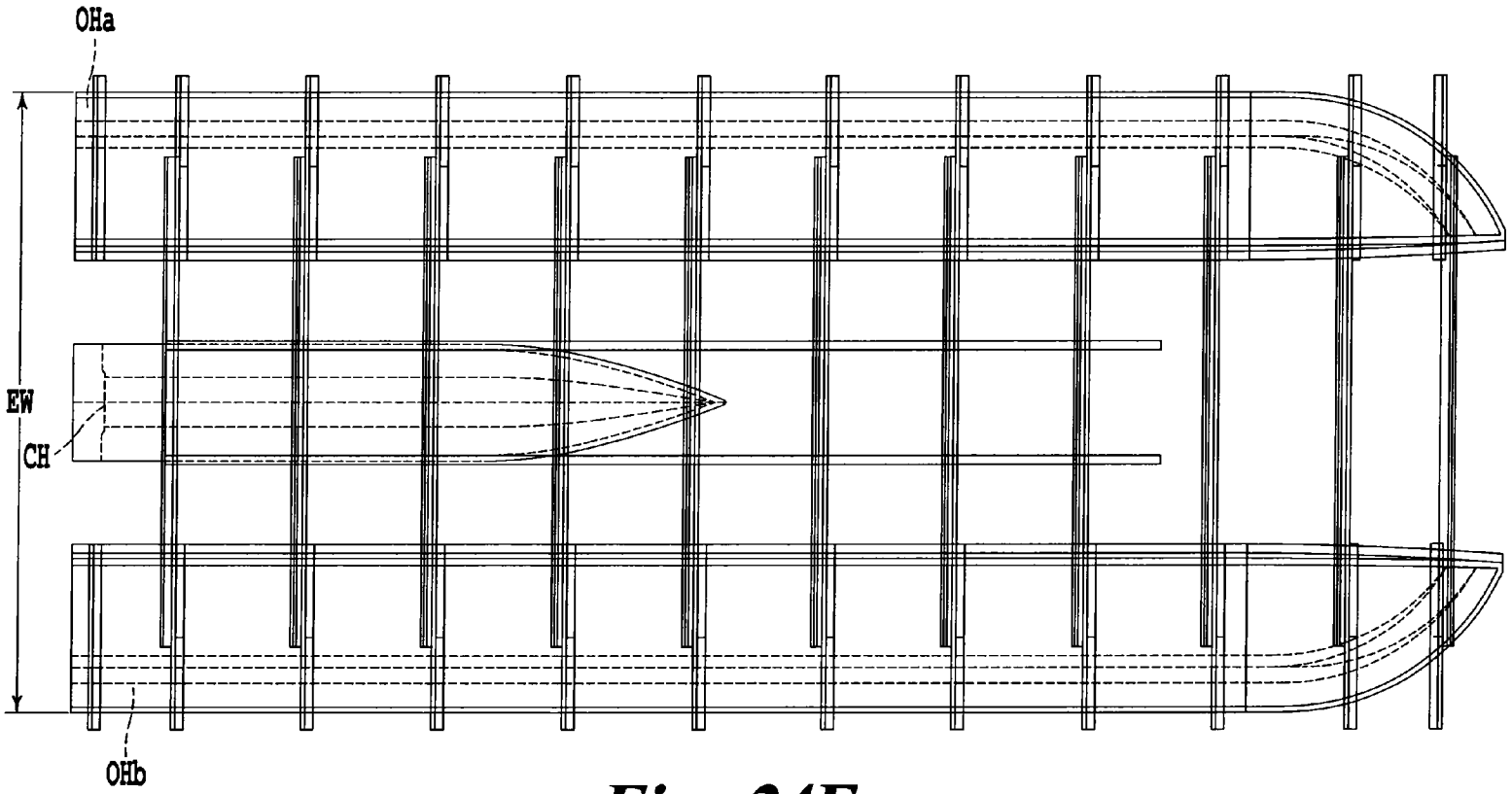

In an alternate embodiment, as shown in FIGS. 24A-C, a trimaran is fitted with any of the above-mentioned expanding and contracting systems. In an exemplary embodiment, the boat has a contracted width of 90" and an expanded width of 120". In an exemplary embodiment, a central beam (300) acts as a backbone, tying all central beams together. In an exemplary embodiment, the central beam (300) is a 1" by 2" by ¼" beam with a length of 184" along the longitudinal direction of the boat. In an exemplary embodiment, each outer hull is attached to a beam (106), while the central hull is attached to a C-track type beam (102). In an exemplary embodiment, beams (106) have a length of 34", and the C-track beam (102) has a length of 90", transverse to the longitudinal direction of the boat. In an expanded configuration, the outer hulls (OHa, Ohb) move inward towards the central hull (CH) as the beams (106) slide along the c-track type beam (102), while the side panels OFa and Ofb are raised and slide over the central panel (CF). In alternative embodiments, the side panels are lowered and slide under the central panel (CF). In alternative embodiments, panels of the boat deck are otherwise adjusted to reduce the width of the boat deck from the expanded to the contracted configuration.

Figure 25A:
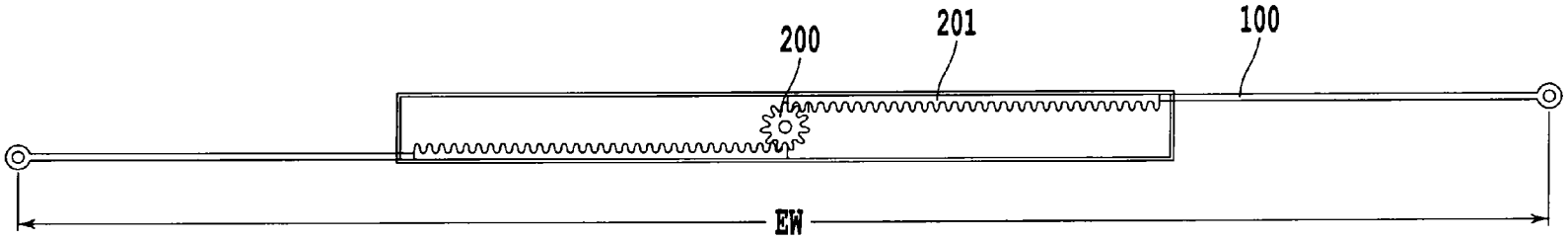
FIGS. 25A-B depict expanded and contracted views of an exemplary embodiment.
Figure 25B:
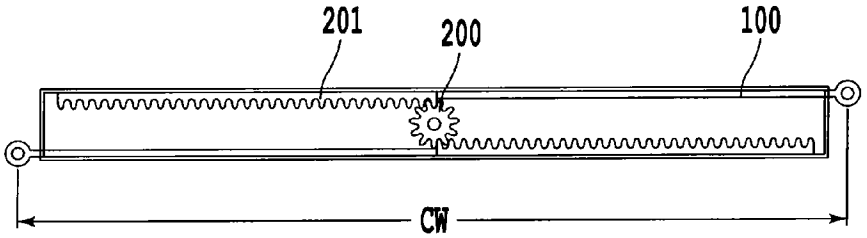

In an alternate embodiment, as shown in FIGS. 25A-B, the expansion and contraction of the boat floor is obtained with a gear and geared rail mechanism. In this exemplary embodiment, a gear (200) is located between upper and lower rods (100) which have a portion including a geared rail (201). As the geared rails move over the gear (200), the boat floor transitions from an expanded width (EW) to a contracted width (CW) as shown in FIGS. 25A and 25B. In an exemplary embodiment, the expanded width is 63" while the contracted width is 33".

In an alternate embodiment, a boat has a single floor panel, with hulls which are attached to a contracting and expanding mechanism, such that the distance between the hulls can be reduced to fit onto a trailer, and increased when the boat is used, but the overall dimensions of the floor panel remain constant. In an exemplary embodiment, a gear and geared rail system, such as the one shown in FIGS. 25A and B, are used to move the hulls. In alternate embodiments, any of the above-described expansion and contraction mechanisms can be used to move the hulls from an expanded to a contracted configuration.

The invention claimed is:

1. A boat floor comprising:

a central floor panel;

a first beam supporting the central floor panel;

at least one side panel, which is parallel to the central floor panel;

at least one pair of beams supporting the at least one side panel;

wherein in an expanded configuration the central floor panel and the at least one side panel are at the same height and the platform has a first width, wherein in a contracted configuration, the central floor panel is higher than and parallel to the at least one side panel, and the platform has a second width, wherein the first width is larger than the second width, and wherein the first beam and the at least one pair of beams are parallel to each other in both the expanded configuration and the contracted configuration.

2. The boat floor as claimed in claim 1, further comprising:

at least one bracket connecting the first beam to the at least one pair of beams.

3. The boat floor as claimed in claim 2, wherein the bracket connects the first beam to the at least one pair of beams by a guide pad eye on one end, and a slide mechanism on another end.

4. The boat floor as claimed in claim 3, wherein the slide mechanism includes a sliding piece which slides inside the first beam.

5. The boat floor as claimed in claim 2, wherein the at least one pair of beams is connected by a dog-bone piece located between beams of the at least one pair of beams.

6. The boat floor as claimed in claim 3, wherein the guide pad eye is connected to a beam of the at least one pair of beams by an outer end cap.

7. The boat floor as claimed in claim 1, wherein the first width is between 84" and 120", and the second width is between 72" and 102".

8. The boat floor as claimed in claim 7, wherein the first width is substantially 120", and the second width is substantially 84".

9. A method for changing a width of a boat floor, including a central panel and a side panel parallel to the central panel, a first beam supporting the central floor panel and at least one pair of beams supporting the at least one side panel, the method comprising:

actuating an actuator;

raising, via the actuator, a central panel of the platform above a side panel of the platform; and sliding the side panel of the platform toward a center of the central panel to reduce the width of the boat floor from a first width in an expanded configuration to a second width in a contracted configuration, wherein the side panel is parallel to the central panel in an expanded configuration and in a contracted configuration, and wherein the first beam and the at least one pair of beams are parallel to each other in an expanded configuration and in a contracted configuration.

10. The method as claimed in claim 9, wherein the first width is between 84" and 120", and the second width is between 72" and 102".

11. The method as claimed in claim 10, wherein the first width is substantially 120", and the second width is substantially 84".

12. A boat floor comprising:

a central floor panel;

a first beam supporting the central floor panel;

a first side panel;

a second side panel;

at least one pair of beams supporting the at least one of the side panels;

wherein in an expanded configuration, the first side panel is on a first side of the central floor panel, and the second side panel is on a second side of the central floor panel, opposite to the first side of the central floor panel, with the central floor panel, the first side panel and the side panel all at a same height and parallel to each other, wherein in a contracted configuration, the central floor panel is higher than the first side panel and the second side panel, parallel to both side panels, and at least partially overlaps both the first side panel and the second side panel, such that a first width of the boat floor in the contracted configuration is smaller than a second width of the boat floor in the expanded configuration, and wherein the first beam and the at least one beam are parallel to each other in an expanded configuration and in a contracted configuration.

13. The boat floor as claimed in claim 3, wherein during a configuration change the bracket both pivots about the end connected to the slide mechanism, and slides with the slide mechanism along the first beam.

14. The boat floor as claimed in claim 3, wherein the guide pad eye is fixedly connected to the at least one pair of beams.

15. The boat floor as claimed in claim 13, wherein during a configuration change the guide pad eye pivots relative to the bracket.

16. The boat floor as claimed in claim 3, further comprising an end cap toe guard at both ends of the first beam, located above the at least one pair of beams.

17. A boat floor comprising:

a central floor panel;

at least one side panel, which is parallel to the central floor panel;

a first beam supporting the central floor panel;

at least one pair of beams supporting the at least one side panel;

at least one bracket connecting the first beam to the at least one pair of beams;

wherein in an expanded configuration the central floor panel and the at least one side panel are at the same height and the platform has a first width, wherein in a contracted configuration, the central floor panel is higher than and parallel to the at least one side panel, and the platform has a second width, wherein the first width is larger than the second width, and wherein the bracket connects the first beam to the at least one pair of beams by a guide pad eye on one end, and a slide mechanism on another end.

18. The boat floor as claimed in claim 17, wherein the slide mechanism includes a sliding piece which slides inside the first beam.

19. The boat floor as claimed in claim 17, wherein the guide pad eye is connected to a beam of the at least one pair of beams by an outer end cap.

20. A boat floor comprising:

a central floor panel;

at least one side panel, which is parallel to the central floor panel;

a first beam supporting the central floor panel;

at least one pair of beams supporting the at least one side panel;

at least one bracket connecting the first beam to the at least one pair of beams;

wherein in an expanded configuration the central floor panel and the at least one side panel are at the same height and the platform has a first width, wherein in a contracted configuration, the central floor panel is higher than and parallel to the at least one side panel, and the platform has a second width, wherein the first width is larger than the second width, and wherein the at least one pair of beams is connected by a dog-bone piece located between beams of the at least one pair of beams.

* * * * *